United States Patent [19]

Sinclair et al.

[11] 4,201,275

[45] May 6, 1980

[54] MEANS FOR THE RENOVATING AND REFURBISHING OF OVERHEAD STRUCTURES

[75] Inventors: Alexander S. Sinclair, Cheadle; Barry C. Eccleston, Consett, both of England

[73] Assignee: A. Monk & Company Limited, Cheshire, England

[21] Appl. No.: 843,294

[22] Filed: Oct. 18, 1977

[30] Foreign Application Priority Data

Oct. 20, 1976 [GB] United Kingdom ..... 43429/76

[51] Int. Cl.[2] ..... E04G 3/12; E04G 3/16

[52] U.S. Cl. ..... 182/37; 182/142; 182/150

[58] Field of Search ..... 182/12, 13, 14, 36, 182/37, 38, 142, 150

[56] References Cited

U.S. PATENT DOCUMENTS

| | | | |
|---|---|---|---|
| 1,929,325 | 10/1933 | Masterson | 182/36 |
| 2,930,441 | 3/1960 | Lacy | 182/37 |
| 3,394,776 | 7/1968 | Abrams | 182/36 |
| 4,074,789 | 2/1978 | Warren | 182/142 |

FOREIGN PATENT DOCUMENTS

| | | | |
|---|---|---|---|
| 626314 | 9/1932 | Fed. Rep. of Germany | 182/36 |
| 300577 | 4/1971 | U.S.S.R. | 182/36 |
| 511418 | 4/1976 | U.S.S.R. | 182/36 |

*Primary Examiner*—Reinaldo P. Machado
*Attorney, Agent, or Firm*—William A. Drucker

[57] ABSTRACT

The invention provides a method for furbishing or renovating large span overhead structures, for example the roofs of railway stations, or bridges and the like, and utilizes apparatus which comprises a plurality of runway beams suspended in spaced parallel disposition from the main ribs or framework of an overhead structure said beams spanning a plurality of said ribs or framework and being longitudinally displaceable relative thereto, and a work platform or platforms suspended from said runway beams and being displaceable therealong. Thus arranged, the overhead structure can be treated for substantially its entire length by alternately advancing the work platforms along the runway beams and the runway beams relative to the structure.

3 Claims, 9 Drawing Figures

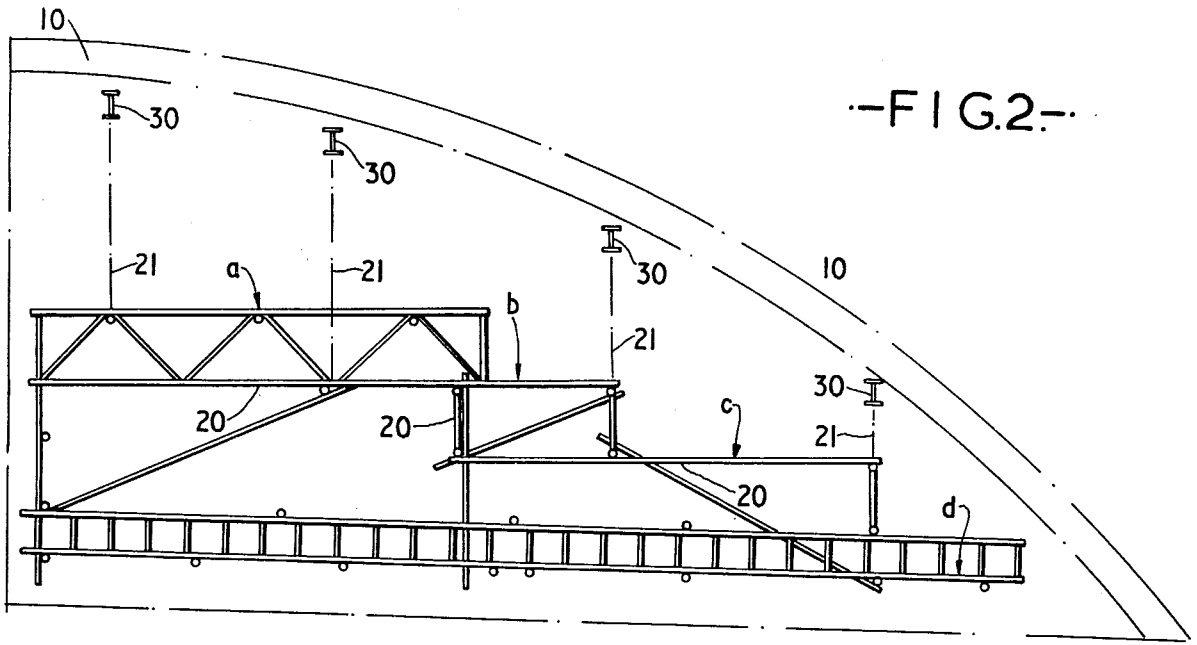
-FIG.2-

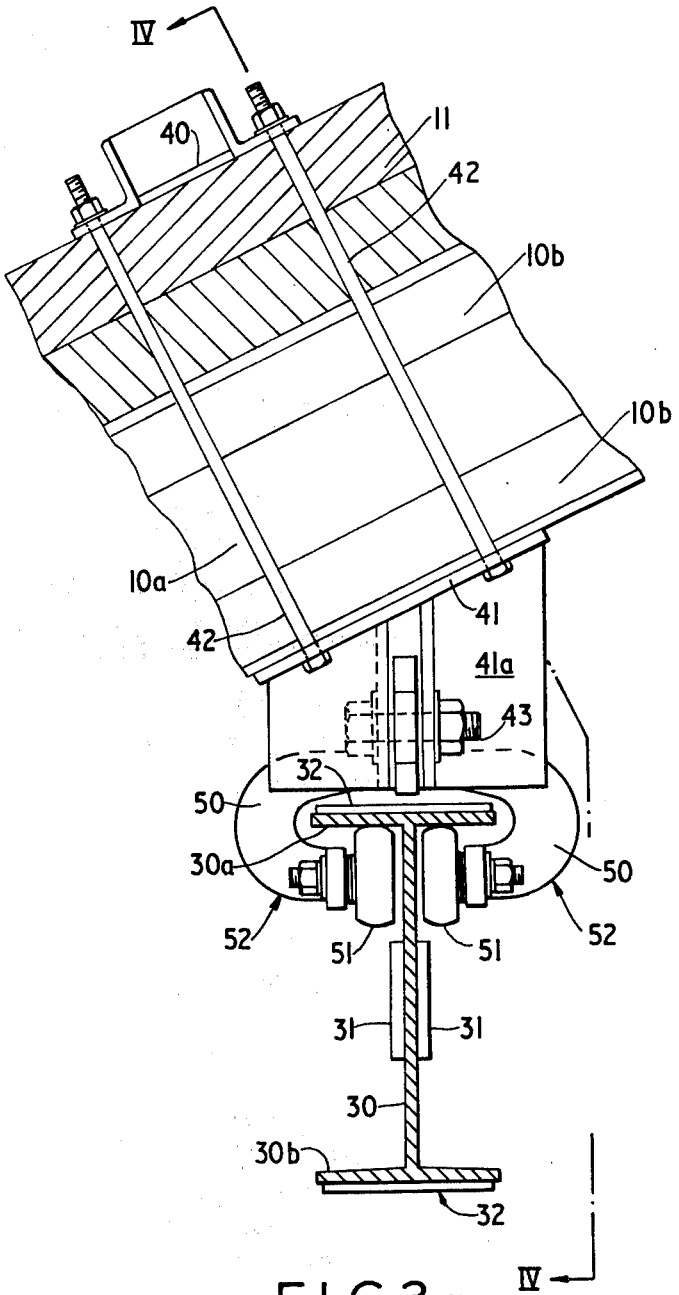
-FIG.3-

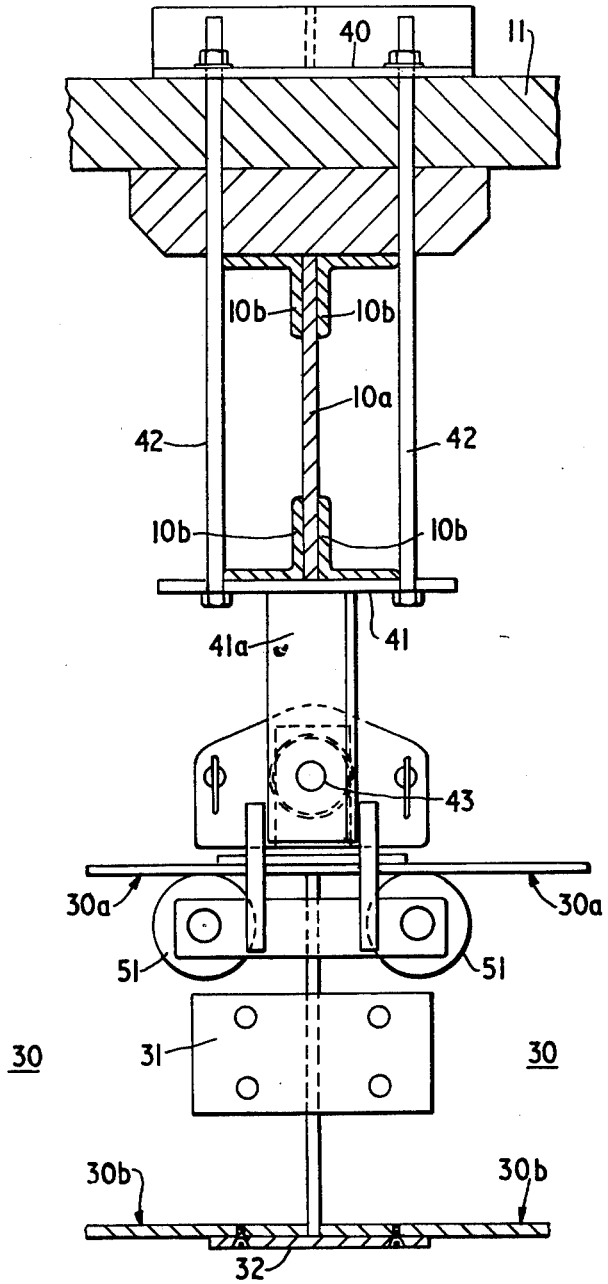
-FIG.4.-

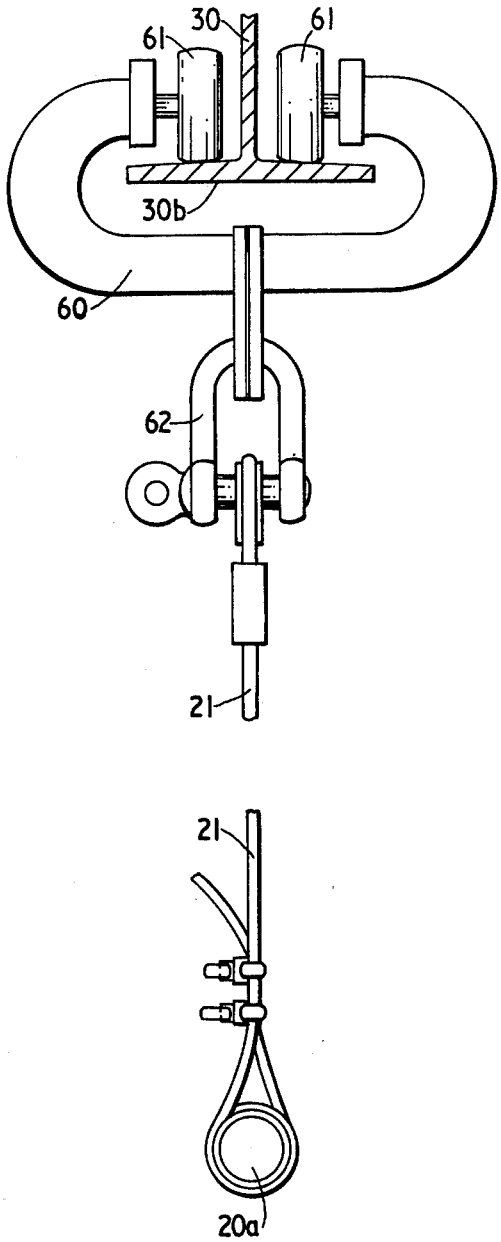
-FIG.5-

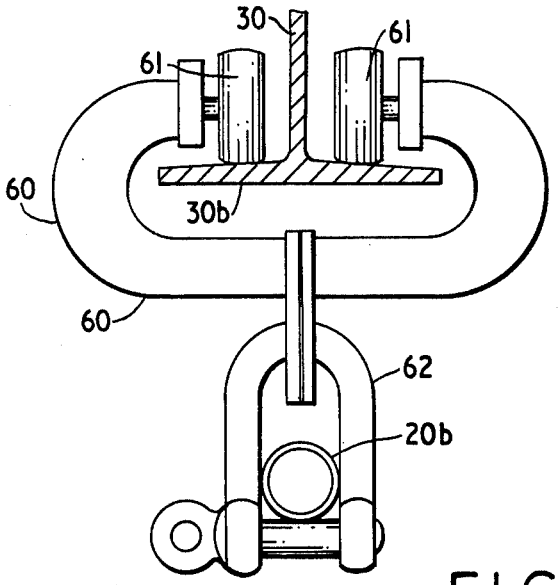
-FIG.6-
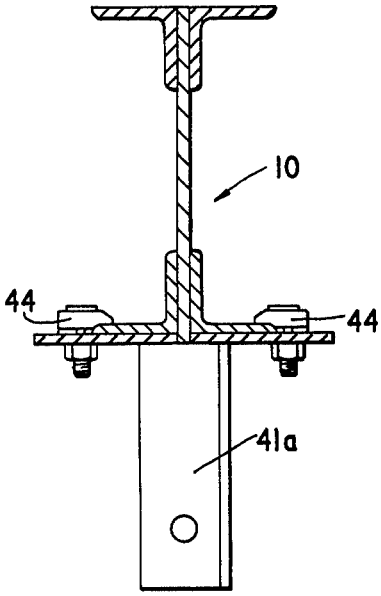
-FIG.7-

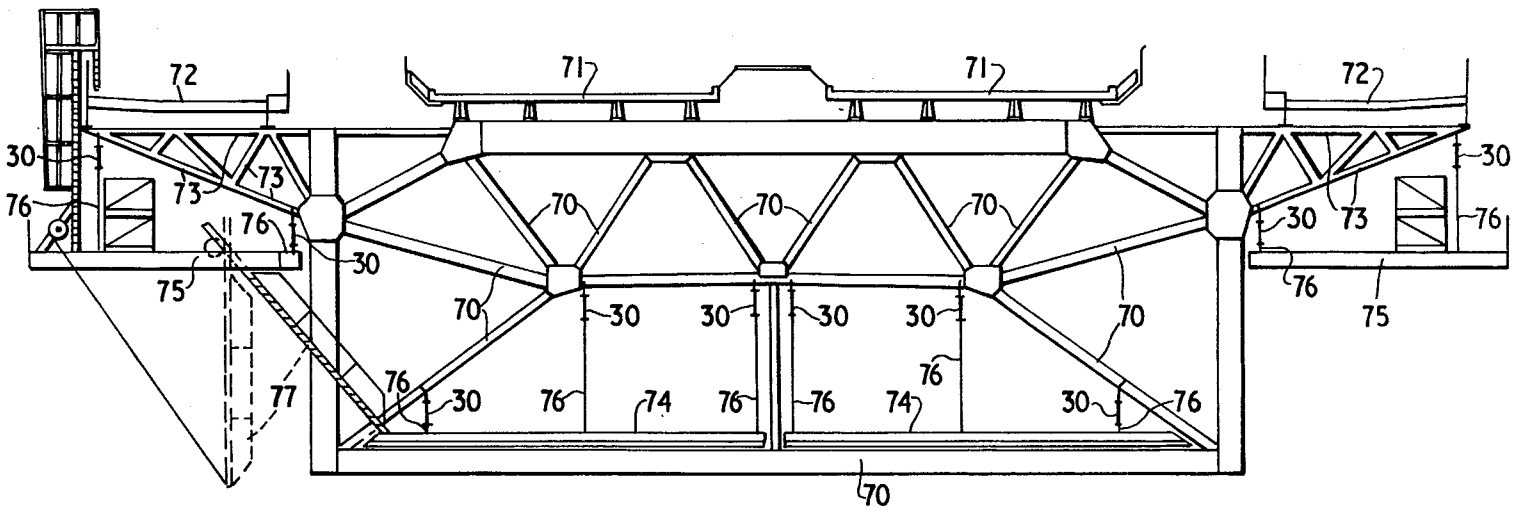
-FIG.8-

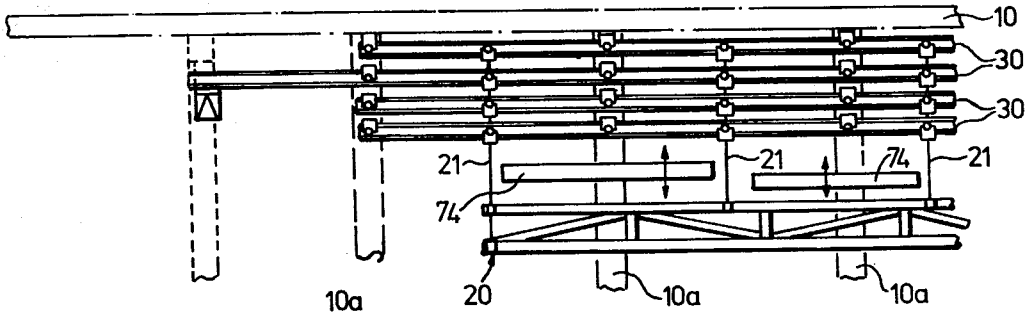
-FIG.9-

MEANS FOR THE RENOVATING AND REFURBISHING OF OVERHEAD STRUCTURES

This invention relates to the treating, e.g. renovating, furbishing or painting of large span overhead structures, for example the roofs of railway stations, bridges and the like.

Overhead structures of the kind referred to usually comprise a plurality of uniformly spaced main ribs and/or fabricated framed trusses or girders which support and are connected by the roof or other cladding. In the treating of such a structure it is preferred that the work is carried out without a complete dismantling of the structure and without impeding the free flow of traffic therebelow.

The present invention has for its object to provide a new or improved method for carrying out such operations in an economic and efficient manner and with a minimum of disruption of the working area below the structure.

The invention comprehends the method of refurbishing an overhead structure, such as a roof or bridge, which comprises:

(a) Securing beam trolley elements to the main arch ribs or frames of the structure at predetermined positions;

(b) Lifting runway beam sections and engaging same with the wheels of said trolley elements whereby said runway beams are displaceably associated with said main arch ribs or frames;

(c) Suspending lightweight mobile cradles from said runway beams, (d) Adding further beam trolley elements to succeeding main arch ribs or frames utilising said mobile cradles;

(e) Lifting in further sections of runway beams and connecting same to the first sections;

(f) Repeating operations (d) and (e) until a sufficient number of main arch ribs or frames (depending upon the load to be supported) have been spanned by said runway beams;

(g) Lifting working platform(s) into operative proximity with the structure and suspending same from the runway beams via beam trolleys; and (h) Treating succeeding sections of the structure by alternately advancing the working platforms along the runway beams and the runway beams relative to the main ribs or frames as required.

Movement of the platforms and beams may be effected in any convenient and controlled manner, e.g. by winching.

Preferably said working platform or platforms extend laterally the full width of the structure, being suspended from a plurality of spaced parallel runway beams, and is or are of sufficient length to span a plurality of the main ribs or frames. Provision can be made for suspending a light weight cradle or cradles from the working platform or platforms whereby renovations are enabled at levels below the working platforms for example in respect of tie rods associated with the main ribs or frames.

The invention is further described with the aid of the accompanying drawings which illustrate schematically, and by way of example only, one embodiment of apparatus and its manner of use in accordance with the invention.

In said drawings:

FIG. 2 is a section on line II—II of FIG. 1.

FIG. 3 is a section through a runway beam showing the method of connecting same with a main roof rib, and FIG. 4 is a section on line IV—IV of FIG. 3.

FIG. 5 is a fragmentary view of the working platform suspension means, and

FIG. 6 is a similar view of a modified suspension unit.

FIG. 7 shows an alternative method of connecting a runway beam to a refurbished main roof rib.

FIG. 8 shows schematically and by way of a transverse section the application of the invention to a bridge structure.

FIG. 9 is a schematic plan view of the "mobile cradle."

Figure 1:
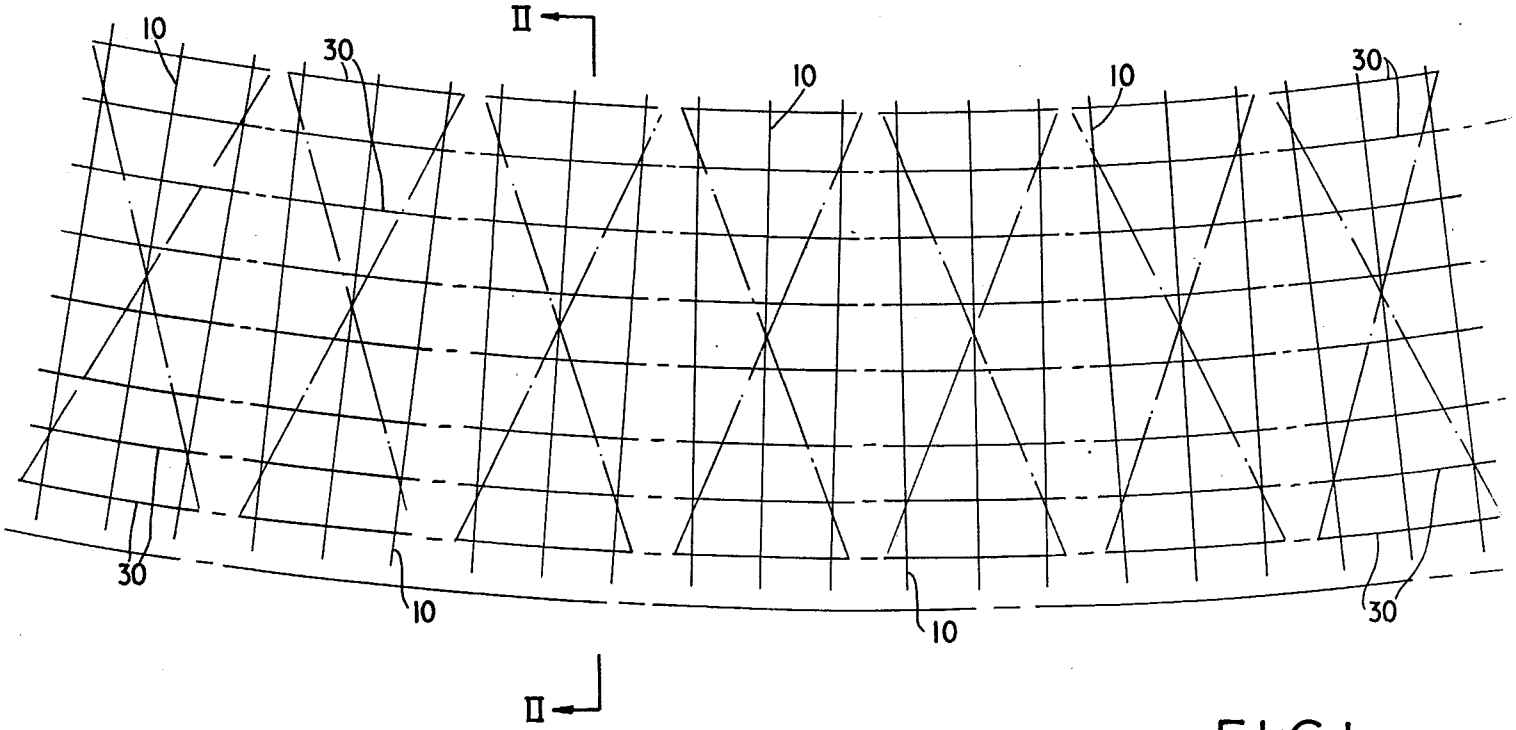
FIG. 1 is a schematic half plan view of an arched roof structure the other half being symmetrical.

Referring to said drawings, and first to FIGS. 1–7 and 9, an arched roof structure (FIGS. 1 and 2) to be furbished comprises a plurality of main ribs 10 which support a timber or other cladding 11 (FIGS. 3 and 4). Each of said main ribs is of a fabricated "I" section comprising a central web **10*a* and four angle sections members 10*b* attached thereto. In some cases only the members 10*b*** need renewing, in other cases entire ribs may need replacing.

In accordance with the present invention, access to the underside of the roof structure is obtained, in respect of each half roof section, by means of a working platform 20, said platform 20 being suspended by suspenders 21 from a series of runway beams 30 in turn suspended from the main ribs 10. Said runway beams 30 are of a length, or are connected in lengths, sufficient to span and be supported from a plurality of main ribs. Said runway beams are of "I" section comprising upper flanges **30*a* and lower flanges 30*b***.

The runway beams 30 are connected with the main ribs 10 at each suspension point (see FIGS. 3 and 4) by means of clamp plates 40, 41 positioned respectively above and below the rib 10 and cladding 11 and rigidly connected by bolts 42. The lower clamp plate 41 comprises a bracket **41*a* whereto is secured by a bolt 43 a beam trolley element 50 which comprises two pairs of wheels 51. The wheels 51 are carried by 'C' members 52 of the trolley element and are arranged to run on the under side of the upper flanges 30*a* of the respective beam 30. The runway beams 30 are thus associated with the main ribs 10 by means of a plurality of trolley wheels 50** and can thus readily be moved relatively of said ribs.

The suspenders 21 of the working platform 20 are each connected with the runway beams 30 by means of a beam trolley 60 (see FIGS. 5 and 6) the pairs of wheels 61 whereof run on the lower flanges **30*b* of the respective beams 30. The trolley 60 is connected by a shackle 62 with the suspender 21 which may be of wire rope. The lower end of the suspender 21 is connected with a frame member 20*a* of the platform 20**.

Referring to FIG. 6, this shows the shackle 62 of the trolley 60 connected directly with a frame member **20*b* of the platform 20. This latter arrangement is used where the distance between a main rib 10 and the platform 20 is at a minimum, e.g. adjacent the lower end of a rib 10** and enables a stable connection of adjacent platforms which is important during movement of the platforms.

Referring to the platform 20, this is conveniently constructed from tubular steel frame members, e.g.

scaffold tubing, arranged so as to support scaffold boards at a plurality of working levels. In FIG. 2, four working levels a, b, c and d are shown arranged so as to compensate for, and enabling operators to work over, the full curvature of the main ribs 10 without the need for raising or lowering the platform.

In use of the apparatus, roof scaffolding may initially be employed to elevate starter sections of runway beam, as also to lift the working platform (or platforms) into positions, but thereafter as the renovation of each roof bay or section is completed, the runway beams 30 are moved along to span succeeding main ribs to which beam trolley elements 50 are pre-fitted to receive said beams. The sections of the beams 30 are connected one to the other by fish plates 31 bolted to each side of the web and by plates 32 connected to the flanges 30*a*, 30*b*, and provision is made at the end of each beam 30 for the bolting thereto of stop members.

The working platform 20 may include tarpaulin or like covers to prevent debris falling into the covered area. Such tarpaulins may be held in place by scaffold boards of the platform 20 and arranged to direct rainwater which may collect into the roof drains.

It will be seen that the runway beams 30 spread the load of the working platforms over a plurality, depending upon the load to be supported, of the main arch ribs whereby individual intermediate ribs and associated cladding can be isolated and safely worked upon. Inasmuch as the working platforms are displaceable relative to the runway beams which are of a length greater than the length of the working platforms, and the runway beams are displaceable relative to the main ribs, an entire roof structure can be renovated or replaced a section at a time by alternate movement of the platforms and runway beams and this in an efficient and economical manner and without interfering with the working area covered by the roof. The working platforms preferably are of a length which enables the following sequence of operations to be carried out section by section in proper sequence:

(a) inspection, (b) dismantling, (c) furbishing, (d) sealing and painting of the main ribs and (e) recladding.

Where the structural state of the main ribs 10 permit, for example subsequent to their renovation, the connection of the runway beams 30 thereto may be by way of simple clamp fittings 44 fitted to the flanges of the lower angles 10*b*, as shown in FIG. 7.

Referring to FIG. 8 of the drawings, this depicts schematically a transverse section of a bridge structure, for example a suspension bridge structure, 70 generally designating the main support means and cross-bracing for roadways 71. Foot or cycle paths 72 are supported at each side of the roadways by cantilever structures 73.

In accordance with the invention, access to the underside of the main bridge structure 70, e.g. for painting, is obtained by working platforms 74, and to the cantilever structures 73 by working platforms 75. Each of said platforms is suspended by means, generally designated 76, from a series of runway beams 30 in turn suspended from the bridge structure by means similar to those described in relation to previously described FIGS. 1–7 and 9. Installation of the runway beams and working platform can readily be effected from existing maintenance facilities and access towers as invariably provided in respect of major bridge structures.

As before described, the beams 30 spread the loads of the working platforms over a plurality of the bridge stays, and said beams are of greater length than the length of the associated working platforms which are displaceable therealong. Further, the beams 30 are lengthwise displaceable, are hereinbefore described, relative to the bridge structure. Thus, the bridge structure can be treated in an efficient and economical manner along its entire length, e.g. painted, by alternate movement of the platforms and runway beams, and in a much shorter time than has hitherto been practicable. Any suitable means may be provided for effecting relative movement of the runway beams relative to the bridge structure and movement of the working platforms relative to the runway beams, for example winch means. Access to working platforms 74 from the platform 75 and vice versa may be achieved by means of provided ladder means, e.g. a displaceable or retractable ladder as shown at 77.

The working platforms may include elevatable platforms or platform parts power operated so as to be moved readily to required working heights. The power means may comprise electrically motivated pressure fluid piston and cylinder devices.

We claim:

1. The method of treating a large span overhead structure which comprises:

(a) Securing beam trolley elements to ribs or frame members of the overhead structure at predetermined positions;

(b) Lifting runway beam sections and engaging same with the wheels of said trolley elements whereby said runway beams are displaceably associated with said ribs or frame members;

(c) Suspending lightweight mobile cradles from said runway beams;

(d) Adding further beam trolley elements to succeeding ribs or frame members utilising said mobile cradles;

(e) Lifting in further sections of runway beams and connecting same to the first sections;

(f) Repeating operations (d) and (e) until a sufficient number of ribs or frame members (depending upon the load to be supported) have been spanned by said runway beams;

(g) Lifting working platforms into operative proximity with the structure and suspending same from the runway beams via said beam trolley elements; and (h) Treating succeeding sections of the overhead structure by alternately advancing the working platforms along the runway beams and the runway beams relative to the structure as required.

2. A method of treating a large span overhead structure having frame members which comprises the steps of:

(a) securing beam trolley elements to frame members of the overhead structure at spaced positions;

(b) associating, with said beam trolley elements, runway beam elements slidable in said trolley elements and supported thereby over lengths of said runway beam elements exceeding that of a working platform sufficiently to allow advance of the runway beam elements alone;

(c) associating a working platform with said runway beam elements by means of further trolley elements slidable on the runway beam elements;

(d) associating individually with each of said runway beam elements a light weight mobile cradle slidable thereon;

(e) advancing each of the runway beam elements relative to the overhead structure and the working platform, and traversing along that runway beam an associated said mobile cradle whilst securing support of the advance part of that runway beam on a frame member of the overhead structure by a said beam trolley element.

3. A method, according to claim 2, wherein for step (e) and for each beam, a beam trolley element is first secured to the next frame member from the cradle after advancement of the respective beam, and thereafter the beam is then fitted to the trolley element likewise from the cradle.

* * * * *